United States Patent [19]

Brown et al.

[11] 4,266,726

[45] May 12, 1981

[54] FLOW VALVE ARRANGEMENT FOR BEVERAGE DISPENSER

[75] Inventors: Wade R. Brown, St. Charles, Ill.; Werner Mannhardt, Detroit, Mich.

[73] Assignee: Alco Foodservice Equipment Company, Miami, Fla.

[21] Appl. No.: 29,140

[22] Filed: Apr. 11, 1979

[51] Int. Cl.[3] ..... B67D 5/56

[52] U.S. Cl. ..... 239/406; 222/129.1; 222/145; 222/504; 239/470

[58] Field of Search ..... 222/129, 129.1, 129.2, 222/129.3, 129.4, 145, 504; 239/466, 467, 470, 405, 406; 137/604; 141/105, 286, 360

[56] References Cited

U.S. PATENT DOCUMENTS

| | | | |
|---|---|---|---|
| 3,289,948 | 12/1966 | Fuerst | 222/129 X |
| 3,584,762 | 6/1971 | Vantroba | 222/129.1 X |
| 3,727,844 | 4/1973 | Benck | 222/129 X |
| 3,800,826 | 4/1974 | McCann | 222/129.1 X |
| 3,966,091 | 6/1976 | Benck | 222/129.1 |
| 4,128,190 | 12/1978 | Gruber | 222/129.2 |
| 4,156,444 | 5/1979 | Mette | 141/286 |
| 4,170,108 | 10/1979 | Mobsby | 239/406 X |

FOREIGN PATENT DOCUMENTS

| | | |
|---|---|---|
| 631170 | 10/1949 | United Kingdom . |
| 678381 | 9/1952 | United Kingdom . |

*Primary Examiner*—Charles A. Marmor
*Assistant Examiner*—Fred A. Silverberg
*Attorney, Agent, or Firm*—Haight, Hofeldt, Davis & Jambor

[57] ABSTRACT

In a beverage dispenser of the type having a diluent mixed with a syrup to produce the beverage to be dispensed, provision is made for utilizing a relatively high flow rate. To achieve the relatively high flow rate, a depressurizing system utilizing a vortex chamber is located at the output end of the valve arrangement. The flow path of the diluent through the valve arrangement before the depressurizing system is designed to minimize pressure drops. Diluent leaving the depressurizing system has its velocity decreased by a diffusing structure before being passed for mixing with the syrup. The diffusing system also decreases the swirl imparted to the diluent in the depressurizing system.

7 Claims, 4 Drawing Figures

FLOW VALVE ARRANGEMENT FOR BEVERAGE DISPENSER

BACKGROUND OF THE INVENTION

1. Field of the Invention

This invention relates generally to a valve arrangement for a beverage dispenser in which a diluent is mixed with a syrup, and more specifically, this invention relates to a valve arrangement for a beverage dispenser in which carbonated water is mixed with a concentrate for dispensing at a relatively fast rate.

2. Description of the Prior Art

It is desirable that a beverage dispenser discharge the beverage as quickly as possible. However, there are limitations on the rate at which it is desirable to discharge the beverage. For example, if the beverage is dispensed at too high a rate it can splash from the cup or other container into which it is directed. Also, if the container is filled too rapidly it can overflow with the attendant waste of beverage.

However, the most significant limitation on the dispensing rate of a beverage formed by mixing carbonated water with a concentrate is the foaming that can occur. As carbon dioxide is released from solution in carbonated water, the introduction of the concentrate results in foaming of the beverage in the cup. This will either result in overflowing of the cup or in the customer getting a very small portion of the beverage after the foam has dissipated. In most cases, there would be an overlapping of these two effects. Further, the resulting drink after foaming would tend to be flat.

The foaming becomes a problem when a relatively high flow rate is utilized because changes in the direction or size of the carbonated water flow path create greater pressure drops then when a slower flow rate is used. The earlier in the flow path that a pressure drop is experienced, the more time there is for the carbon dioxide to come out of the water. Therefore, it is desirable to have as much of the pressure drop as possible occur immediately prior to mixing of the carbonated water with the concentrate.

Prior attempts to provide a higher dispensing rate have utilized a series of orifices to reduce the pressure prior to mixing of the carbonated water with the concentrate. While the pressure can be reduced in this fashion, the velocity of the carbonated water and the mixed beverage is still very high with the attendant problems. Therefore, relatively slow flow rates have been utilized in prior art beverage dispensers.

SUMMARY OF THE INVENTION

With the present invention, flow rates approximately twice those utilized in conventional beverage dispensers may be achieved. These greatly increased flow rates are achieved without any significant increase in the foaming of the dispensed beverage.

In the valve arrangement of the present invention a body member has a syrup or concentrate passage formed therein for receiving and conveying a syrup, such as a desired beverage concentrate. A diluent or carbonated water passage is also formed in the body member for receiving and conveying a suitable diluent, such as carbonated water. A syrup or concentrate valve selectively blocks or permits concentrate flow through the concentrate passage. Similarly, a diluent or carbonated water valve selectively blocks or permits carbonated water flow through the carbonated water passage.

The concentrate valve and the carbonated water valve are both suitable on-off valves, such as solenoid actuated poppet valves.

Substantially constant rates of flow of concentrate and carbonated water are achieved by utilization of a suitable flow control arrangement. This flow control arrangement may take the form of a spring biased piston flow controller for the concentrate and a separate spring biased piston flow controller for the carbonated water.

In order to achieve maximum pressure drop immediately prior to mixing of the carbonated water and the concentrate, a depressurizing system is located at the output of the carbonated water passage. By suitably designing the carbonated water passage, the carbonated water valve and the carbonated water flow control, most of the pressure of the carbonated water may be retained until it reaches the depressurizing system. Basically, this is achieved by designing the flow path for the carbonated water to be as large as possible with as few changes of direction as possible.

The depressurizing system has an outer ring chamber into which the carbonated water from the carbonated water passage flows. A vortex chamber is formed internally of said outer ring chamber and is connected to said ring chamber by one or more vortex openings. In the preferred embodiment disclosed herein, a plurality of vortex openings are utilized and the ring chamber is decreased in size after each vortex opening to cause an approximately equal amount of carbonated water to pass through each of the vortex openings. In the vortex chamber, the carbonated water has some swirl imparted to it. While the pressure is decreased in the vortex chamber, the velocity of the carbonated water is increased.

In order to decrease the velocity and swirl imparted to the carbonated water in the vortex chamber, a suitable diffusing structure is provided. This diffuser structure includes a diffuser element located about a concentrate tube that is positioned to receive concentrate from the concentrate passage. The diffuser element has a frusto-conical internal cavity. A diffuser opening is formed between the diffuser element and the concentrate tube to convey carbonated water from the vortex chamber to the smaller end of the frusto-conical cavity. As the carbonated water passes through the increasing volume between the outer surface of the concentrate tube and the surface of the diffuser element that defines the frusto-conical cavity, the velocity of the carbon dioxide is decreased.

Formed along the outer surface of the concentrate tube are one or more ribs that extend along the concentrate tube and outwardly toward the frusto-conical surface of the diffuser element. In the preferred embodiment disclosed herein, five such ribs are utilized. There ribs serve to decrease the swirl in the carbonated water passing out of the vortex chamber.

Below the large end of the frusto-conical cavity, a protruding shoulder is formed on the concentrate tube. The upper portion of this shoulder is shaped to impede the carbonated water flow sufficiently to fill the space between the frusto-conical surface of the diffuser element and the outer surface of the concentrate tube with carbonated water. The lower portion of the protruding shoulder is formed to decrease the velocity of the carbonated water to a desired value before it passes into a nozzle for mixing with the concentrate. A discharge head at the end of the concentrate tube away from the concentrate passage projects the concentrate into the nozzle for mixing with the carbonated water. The mixtue of concentrate and carbonated water is then dispensed.

These and other objects, advantages and features of this invention will hereinafter appear, and for purposes of illustration, but not of limitation, an exemplary embodiment of the subject invention is shown in the appended drawing.

DETAILED DESCRIPTION OF THE PREFERRED EMBODIMENT

Figure 3:
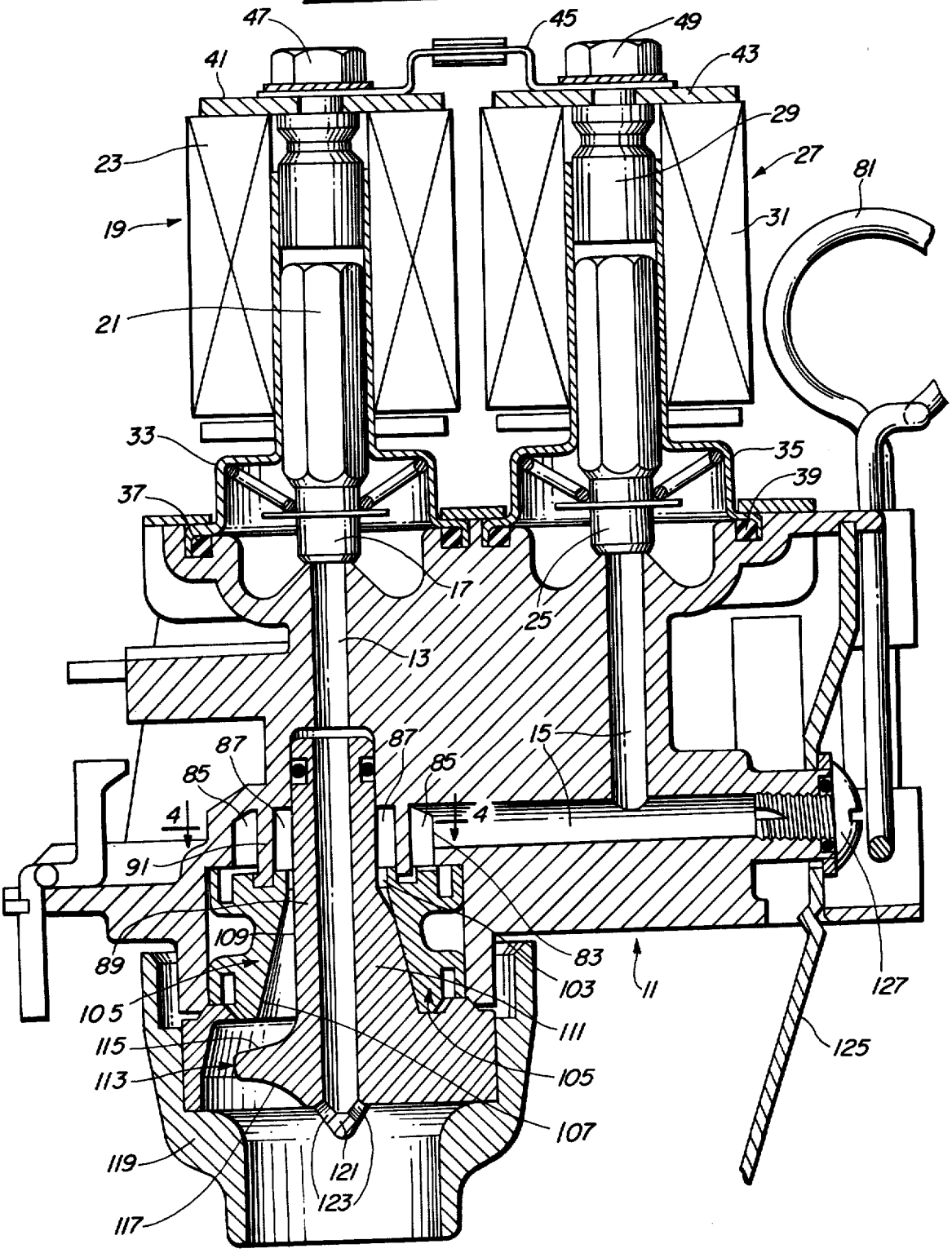
FIG. 3 is a cross sectional view taken along line 3—3 of FIG. 2, with some components illustrated in perspective.

A body member 11 of the valve arrangement of the present invention is best seen in FIG. 3. A syrup or concentrate passage 13 is formed in body member 11. Similarly, a diluent or carbonated water passage 15 is formed in body member 11. Passage 13 is formed to receive and convey a syrup, such as a beverage concentrate. Passage 15 is adapted to receive and convey a diluent, such as carbonated water.

Concentrate flow through passage 13 is selectively blocked or permitted by a concentrate valve 17. Concentrate valve 17 is an on-off flow controller, such as a solenoid actuated poppet valve. Poppet valve 17 is actuated by a solenoid 19 having an armature structure 21 and an actuating coil 23.

Flow of carbonated water through the carbonated water passage is selectively blocked or permitted by a carbonated water valve 25. Carbonated water valve 25 is also an on-off flow controller such as a poppet valve. Carbonated water valve 25 is actuated by a solenoid 27. Solenoid 27 has an armature structure 29 and an actuating coil 31.

Solenoid assembly 19 has a guide or support structure 33, while solenoid assembly 27 has a guide or structure assembly 35. Guides 33 and 35 are secured to body member 11, with suitable gaskets 37 and 39, respectively, providing sealing.

Frames 41 and 43 are located a the tops of solenoid structures 19 and 27, respectively. Frames 41 and 43 are interconnected by a retaining strip 45. Suitable fastening devices, such as lock nuts 47 and 49 connect retaining strip 45 to the frames 41 and 43 and the solenoid structures 19 and 27.

In order to maintain a constant rate of concentrate flow in concentrate passage 13, a concentrate flow control 51 is utilized. While any suitable type of flow control may be used, concentrate flow control 51 utilizes a piston 53 that is reciprocable in a sleeve 55. A compression spring 57 urges piston 53 to the right in the orientation of FIG. 2. The rate of concentrate flow may be adjusted by the screw 59, which adjusts the force of the compression spring 57 on piston 53.

After the desired concentrate flow rate has been determined, concentrate flow from a concentrate tank (not shown) through input 61 will drive piston 53 to the left with a predetermined force. If the pressure of the concentrate increases, the force on 53 will be greater and hence piston 53 will move to the left (FIG. 2 orientation) against the force of spring 57. This serves to decrease the size of the concentrate outlet 63 and thus decreases the rate of concentrate to flow to passage 13 upstream of concentrate valve 17. On the other hand, if the pressure of the concentrate decreases, piston 53 will be urged to the right (FIG. 2 orientation) by the compression spring 57. This will increase the size of the concentrate outlet 63 and thus increase the rate of concentrate flow to passage 13 upstream of concentrate valve 17. In this fashion, variations in pressure are overcome to provide a substantially constant flow of concentrate.

A similar structure is utilized for the carbonated water flow control 65. In this case, a piston 67 reciprocates in a sleeve 69. The force that a compression spring 71 exerts against piston 67, and hence the carbonated water flow rate, is determined by a screw 73. Pressure variations in the carbonated water from a suitable source (not shown) entering through inlet 75 vary the size of carbonated water outlet 77 and hence the rate of flow of carbonated water to passage 15 upstream of carbonated water valve 25. Suitable O-rings 79 are utilized to provide desired sealing for the flow controls 51 and 65.

Figure 1:
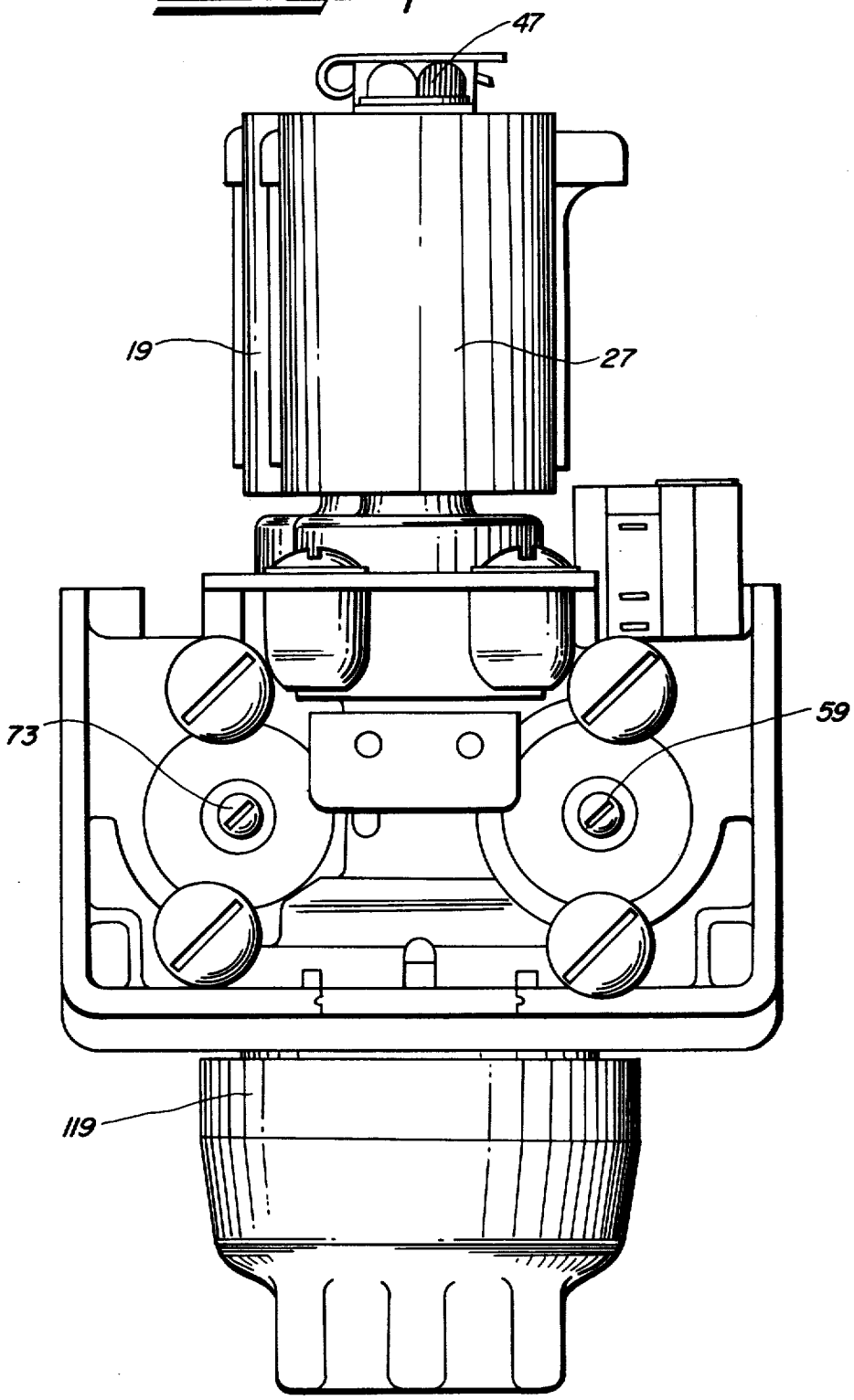
FIG. 1 is an end elevational view of a valve arrangement constructed in accordance with the present invention.
Figure 2:
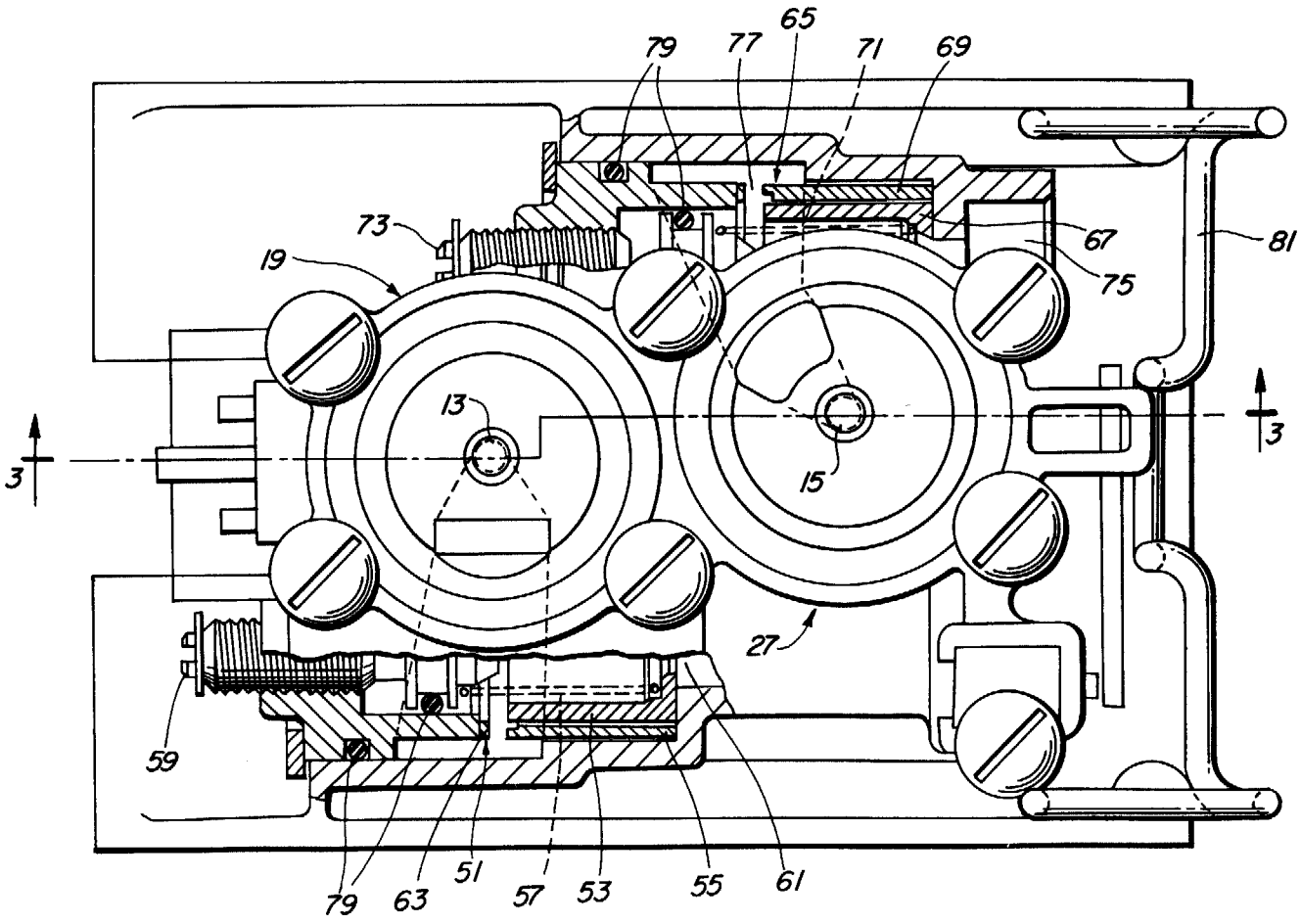
FIG. 2 is a top plan view of the valve arrangement of FIG. 1 with some components removed to permit better visualization of the present invention.

A retainer structure 81 is provided as shown in FIGS. 2 and 3.

In order to permit utilization of relatively fast flow rates, the carbonated water flow path through flow control 65, carbonated water valve 25 and carbonated water passage 15 is made as large as possible and with as few changes of direction as possible. Thus, the pressure of carbonated water appearing at the outlet 83 of carbonated water passage 15 in a substantial percentage of the pressure at carbonated water inlet 75. To remove this pressure for the dispensing operation, a depressurizing system is formed in body member 11. This depressurizing system includes an outer ring chamber 85 that is generally annular in shape. Inwardly spaced from ring chamber 85 is a generally annular vortex chamber 87. Vortex chamber 87 is immediately adjacent a concentrate tube 89 that is adapted to receive concentrate from concentrate passage 13. A portion 91 of body member 11 separates ring chamber 85 from vortex chamber 87.

Figure 4:
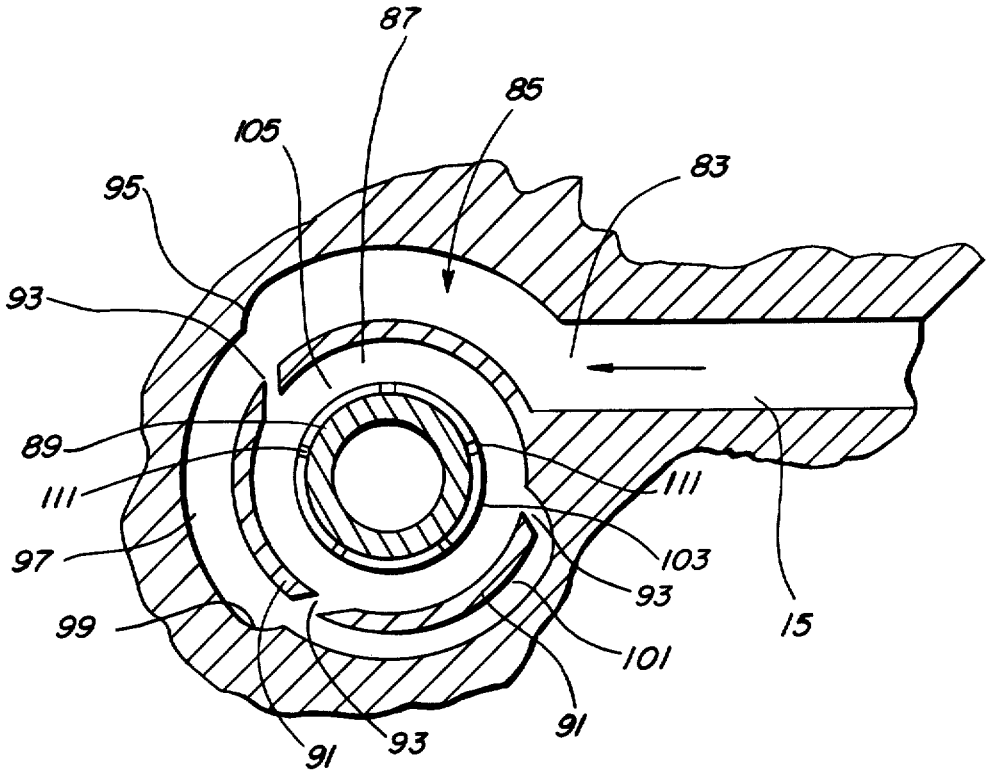
FIG. 4 is an enlarged partial cross sectional view taken line 4—4 in FIG. 3.

With reference to FIG. 4, it may be seen that ring chamber 85 is connected to vortex chamber 87 by openings 93. These openings to the vortex chamber (vortex openings) 93 convey the carbonated water to the vortex chamber 87 where the pressure is greatly decreased (with an attendant rise in the velocity of the carbonated water). A swirl is imparted to the carbonated water in the vortex chamber, which may be enhanced by positioning vortex passages 93 as illustrated. Incidentally, while three vortex openings are illustrated in this preferred embodiment, the number of such vortex openings may be varied.

It may be noted from the top plan view of FIG. 2 that the solenoid structures 19 and 27 are slightly displaced from one another. Thus, the carbonated water passage 15 is inserted into ring chamber 85 slightly displaced from a diameter. As the carbonated water passes around ring chamber 85, the size of the ring chamber is decreased after each opening 93 in order to have the carbonated water passing through each of the openings 93 be substantially equal to that passing through the other openings 93. Thus, in the preferred embodiment disclosed herein, a step 95 decreases the size of ring chamber 85 by one-third, so that portion 97 of the chamber 85 is two-thirds the size of ring chamber 85 at carbonated water outlet 83. Similarly, a step 99 further decreases the size of the portion 101 of ring chamber 85 to one-third the size of chamber 85 at outlet 83.

From vortex chamber 87, the carbonated water having an increased velocity and some imparted swirl is conveyed through a diffuser opening 103. Diffuser opening 103 is formed by a space between a diffuser element 105 and the concentrate tube 89. Diffuser element 105 has a frusto-conical internal cavity defined by the surface 107. Thus, as the carbonated water is conveyed through diffuser openings 103 it will pass along the expanding space between surface 107 of diffuser element 105 and the outer surface of concentrate tube 89. As the carbonated water passes through this enlarging volume, its velocity will be decreased. In this same volume, there are located one or more ribs 111 that extend along the concentrate tube 89 and outwardly toward the frusto-conical surface 107 of diffuser element 105. As may be seen in FIG. 4, a total of five such ribs are employed in this preferred embodiment, but this number may be varied. Ribs 111 serve to decrease the swirl in the carbonated water coming from vortex chamber 87.

Beyond the large end of the frusto-conical cavity in diffuser element 105, a protruding shoulder 113 is formed on concentrate tube 89. The upper portion 115 of this protruding shoulder 113 is shaped to impede the flow of carbonated water and to fill the space between surfaces 107 and 109 with the carbonated water. The lower portion 117 of protruding shoulder 113 is formed to decrease the velocity of the carbonated water to a desired value before the water passes into a nozzle 119.

A discharge head 121 is located at the end of concentrate tube 89 away from concentrate passage 13. Discharge head 121 has discharge openings 123 for projecting concentrate into nozzle 119 for mixing with the carbonated water. The mixture of concentrate and carbonated water is then dispensed to a cup or other container located below nozzle 119.

An actuating handle 125 is secured to body member 11 by a screw 127, which also functions to plug the carbonated water passage 15. In operation, the actuating handle 125 would be pivoted to energize solenoids 19 and 27. Solenoids 19 and 27 would remain energized for an appropriate time to permit flow of the proper amounts of concentrate and carbonated water to fill the cup or container. The concentrate and carbonated water would be conveyed through passages 13 and 15 to be mixed in nozzle 119 and dispensed.

It should be understood that various modifications, changes and variations may be made in the arrangement, operation and details of construction of the elements disclosed herein without departing from the spirit and scope of this invention.

We claim:

1. A valve arrangement for apparatus having relatively fast flow of a diluent to be mixed with a syrup for dispensing a mixed beverage comprising:

a body member;

a diluent passage formed in said body member for receiving and conveying pressurized diluent;

a diluent valve to selectively block or permit diluent flow through said diluent passage;

a syrup passage formed in said body member for receiving and conveying syrup;

a syrup valve to selectively block or permit syrup flow through said syrup passage;

a syrup tube to receive syrup from said syrup passage and convey the syrup to a location for mixing with the diluent;

depressurizing means located at the end of said diluent passage to lower the pressure of diluent that flows from said diluent passage, said diluent passage and said diluent valve being designed to minimize the pressure drop prior to said depressurizing means;

a diffuser element adapted to fit over said syrup tube, said diffuser element having a frusto-conical interior cavity;

a diffuser opening formed between said diffuser element and said syrup tube to convey diluent from said depressurizing means to the smaller end of said frusto-conical cavity; and a protruding shoulder formed on said syrup tube beyond the large end of said frusto-conical cavity, the upper portion of said shoulder being shaped to impede diluent flow sufficiently to fill with diluent the space between the surface of said diffuser element forming said frusto-conical cavity and the outer surface of said syrup tube, the lower portion of said shoulder being shaped to decrease the velocity of the diluent to a desired value.

2. A valve arrangement for apparatus having relatively fast flow of a diluent to be mixed with a syrup for dispensing a mixed beverage comprising:

a body member;

a diluent passage formed in said body member for receiving and conveying pressurized diluent;

a diluent valve to selectively block or permit diluent flow through said diluent passage;

a syrup passage formed in said body member for receiving and conveying syrup;

a syrup valve to selectively block or permit syrup flow through said syrup passage;

an outer ring chamber formed in said body member to receive diluent from said diluent passage;

a vortex chamber formed in said body member;

a plurality of vortex openings connecting said outer ring chamber to said vortex chamber, said outer ring chamber being decreased in size beyond each of said openings to cause an approximately equal amount of diluent to pass through each of said vortex openings, the pressure of the diluent being lowered in said ring chamber and said vortex chamber while the velocity thereof is increased and a swirling motion is imparted thereto; and diffuser means to decrease the velocity of the diluent that leaves said vortex chamber.

3. A valve arrangement as claimed in claim 2 wherein a syrup tube is provided to receive syrup from said syrup passage and said diffuser means comprises:

a diffuser element adapted to fit over said syrup tube, said diffuser element having a frusto-conical interior cavity;

a diffuser opening formed between said diffuser element and said syrup tube to convey diluent from said vortex chamber to the smaller end of said frusto-conical cavity; and a protruding shoulder formed on said syrup tube beyond the large end of said frusto-conical cavity, the upper portion of said shoulder being shaped to impede diluent flow sufficiently to fill with diluent the space between the surface of said diffuser element forming said frusto-conical cavity and the outer surface of said syrup tube, the lower portion of said shoulder being shaped to decrease the velocity of the diluent to a desired value.

4. A valve arrangement as claimed in claim 1 or 3 and further comprising at least one rib extending along said syrup tube in said frusto-conical cavity to decrease the swirl of the diluent.

5. A valve arrangement as claimed in claim 1 or 2 and further comprising flow control means to maintain a substantially constant flow rate of diluent in said diluent passage and a substantially constant flow rate of syrup in said syrup passage.

6. A valve arrangement as claimed in claim 1 or 2 wherein said diluent valve and said syrup valve are solenoid actuated poppet valves.

7. A valve arrangement for use in dispensing a beverage formed by mixing carbonated water with a concentrate, the carbonated water having a relatively fast flow, comprising:

a body member;

a concentrate passage formed in said body member to receive and convey concentrate;

concentrate flow control means to introduce concentrate into said concentrate passage at a substantially constant flow rate;

a concentrate valve to selectively block or permit concentrate flow through said concentrate passage;

a concentrate tube to receive concentrate from said concentrate passage;

a nozzle secured to said body member;

a discharge head located on the end of said concentrate tube away from said concentrate passage to discharge concentrate into said nozzle;

a carbonated water passage formed in said body member to receive and convey carbonated water;

carbonated water flow control means to introduce carbonated water into said carbonated water passage at a substantially constant flow rate;

a carbonated water valve to selectively block or permit carbonated water flow through said carbonated water passage;

a generally annular ring chamber formed in said body member to receive carbonated water from said carbonated water chamber;

a generally annular vortex chamber formed in said body member internally of said ring chamber;

a plurality of vortex openings connecting said ring chamber to said vortex chamber to pass carbonated water to said vortex chamber in order to impart a swirling motion to the carbonated water, said ring chamber being decreased in size beyond each successive vortex opening to cause an approximately equal amount of carbonated water to pass through each of said vortex openings;

a diffuser element adapted to fit over said concentrate tube, said diffuser element having a frusto-conical interior cavity;

a diffuser opening formed between said diffuser element and said concentrate tube to convey carbonated water from said vortex chamber to the smaller end of said frusto-conical cavity;

a plurality of ribs formed on said concentrate tube and extending axially along said concentrate tube and outwardly to the surface of said diffuser element defining said frusto-conical cavity, said ribs being positioned to decrease the swirl of the carbonated water; and a protruding shoulder formed on said concentrate tube beyond the large end of said frusto-conical cavity, the upper portion of said shoulder being shaped to impede carbonated water flow sufficiently to fill with carbonated water the space between the surface of said diffuser element defining said frusto-conical cavity and the outer surface of said concentrate tube, the lower portion of said shoulder being shaped to decrease the velocity of the carbonated water to a desired value before the carbonated water passes into said nozzle for mixing with the concentrate.

* * * * *